US008981635B2

(12) United States Patent
Katsuraya et al.

(10) Patent No.: US 8,981,635 B2
(45) Date of Patent: Mar. 17, 2015

(54) HIGH-FREQUENCY SPARK PLUG WITH CENTER ELECTRODE AND TERMINAL ELECTRODE IN DIRECT CONTACT

(75) Inventors: Kohei Katsuraya, Aichi (JP); Tatsunori Yamada, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 13/883,316

(22) PCT Filed: Aug. 23, 2011

(86) PCT No.: PCT/JP2011/068907

§ 371 (c)(1),
(2), (4) Date: May 3, 2013

(87) PCT Pub. No.: WO2012/070288

PCT Pub. Date: May 31, 2012

(65) Prior Publication Data

US 2013/0328477 A1 Dec. 12, 2013

(30) Foreign Application Priority Data

Nov. 25, 2010 (JP) ..... 2010-262063

(51) Int. Cl.
*H01T 13/14* (2006.01)
*H01T 13/34* (2006.01)
*H01T 13/20* (2006.01)

(52) U.S. Cl.
CPC ..... *H01T 13/34* (2013.01); *H01T 13/20* (2013.01)
USPC ..... 313/145

(58) Field of Classification Search
CPC ..... H01T 13/34; H01T 13/20; H01T 13/22
USPC ..... 313/141, 145
See application file for complete search history.

(56) References Cited

U.S. PATENT DOCUMENTS 1,695,632 A * 12/1928 Campbell ..... 313/136
1,976,294 A * 10/1934 Rabezzana ..... 174/152 S (Continued)

FOREIGN PATENT DOCUMENTS

EP 0 933 848 8/1999 ..... H01T 13/41
JP 40-23530 10/1965

(Continued)

OTHER PUBLICATIONS

International Search Report for International Application No. PCT/JP2011/068907, Nov. 1, 2011.
Extended European Search Report issued in connection with corresponding European Patent Application No. 1184769.8, dated Nov. 5, 2014.

*Primary Examiner* — Anh Mai
*Assistant Examiner* — Steven Horikoshi
(74) *Attorney, Agent, or Firm* — Kusner & Jaffe

(57) ABSTRACT

An ignition plug includes an insulator having an axial bore extending in the direction of an axis and an electrode inserted into the axial bore, and generates plasma discharge through supply, to the electrode, of high-frequency power generated by a predetermined high-frequency power supply. The electrode includes a center electrode inserted into the forward side of the axial bore and a terminal electrode inserted into the rear side of the axial bore. In the axial bore, the terminal electrode and the center electrode are fixed to the insulator by means of a glass seal which contains a glass component, and are in direct contact with each other. Thus, ignition performance can be further improved.

7 Claims, 7 Drawing Sheets

(56) References Cited

U.S. PATENT DOCUMENTS

| | | | | |
|---|---|---|---|---|
| 2,106,578 | A * | 1/1938 | Schwartzwalder et al. | 403/28 |
| 3,417,275 | A | 12/1968 | Taylor | 313/139 |
| 3,934,566 | A | 1/1976 | Ward | 123/119 |
| 6,583,537 | B1 * | 6/2003 | Honda et al. | 313/136 |
| 2006/0082275 | A1 | 4/2006 | Lykowski | 313/123 |
| 2006/0220510 | A1 | 10/2006 | Shibata | 313/141 |
| 2009/0033194 | A1 | 2/2009 | Jaffrezic et al. | 313/130 |
| 2011/0139107 | A1 * | 6/2011 | Burrows et al. | 123/169 EL |
| 2011/0254429 | A1 | 10/2011 | Kameda et al. | 313/141 |

FOREIGN PATENT DOCUMENTS

| | | | |
|---|---|---|---|
| JP | 45-005961 | 2/1970 | |
| JP | 51-77719 | 7/1976 | F02H 27/00 |
| JP | 2008-529229 | 7/2008 | H01T 13/54 |
| JP | 2010-135345 | 6/2010 | H01T 13/20 |
| JP | 2010-153330 | 7/2010 | H01T 13/52 |

* cited by examiner (a)

(b)

(a)

(b)

(a)

(b)

HIGH-FREQUENCY SPARK PLUG WITH CENTER ELECTRODE AND TERMINAL ELECTRODE IN DIRECT CONTACT

FIELD OF THE INVENTION

The present invention relates to a high-frequency plasma spark plug (high-frequency plasma ignition plug) which generates plasma discharge through supply of high-frequency power thereto.

BACKGROUND OF THE INVENTION

A spark plug for use in a combustion apparatus, such as an internal combustion engine, includes, for example, an insulator having an axial bore extending in the axial direction; a center electrode provided at the forward side of the axial bore; a terminal electrode provided at the rear side of the axial bore and electrically connected to the center electrode via an electrically conductive glass seal; a tubular metallic shell attached externally to the insulator; and a ground electrode joined to a forward end portion of the metallic shell. Application of high voltage to the center electrode generates spark discharge across the gap formed between the center electrode and the ground electrode; as a result, fuel gas is ignited.

In order to further improve ignition performance, there has been proposed an ignition plug (high-frequency plasma ignition plug) which generates plasma discharge through application of high-frequency power in place of high voltage to the gap (refer to, for example, Japanese Patent Application Laid-Open (kokai) No. S51-77719 "Patent Document 1").

PROBLEMS TO BE SOLVED BY THE INVENTION

In recent years, in order to cope with exhaust gas regulations and to improve fuel economy, lean-burn engines, direct-injection engines, etc., have been actively developed. Such combustion apparatus are required to exhibit ignition performance higher than the conventional level, and further improvement of ignition performance is required of even the above-mentioned high-frequency plasma ignition plug, which has excellent ignition performance.

The present invention has been conceived in view of the above circumstances, and an object of the invention is to provide a high-frequency plasma ignition plug capable of exhibiting further improved ignition performance.

SUMMARY OF THE INVENTION

Means for Solving the Problems

Configurations suitable for achieving the above object will next be described in itemized form. When needed, actions and effects peculiar to the configurations will be described additionally.

Configuration 1. A high-frequency plasma ignition plug of the present configuration comprising an insulator having an axial bore extending in a direction of an axis and an electrode inserted into the axial bore, and adapted to generate plasma discharge through supply, to the electrode, of high-frequency power generated by a predetermined high-frequency power supply, the high-frequency plasma ignition plug being characterized in that the electrode comprises a center electrode inserted into the axial bore at a forward side of the axial bore and a terminal electrode inserted into the axial bore at a rear side of the axial bore;

in the axial bore, the terminal electrode and the center electrode are fixed to the insulator by means of a glass seal which contains a glass component; and the center electrode and the terminal electrode are in direct contact with each other.

According to the above configuration 1, since the center electrode and the terminal electrode are in direct contact with each other without need to provide the glass seal or the like therebetween, power loss can be effectively restrained in transmission of supplied high-frequency power. As a result, plasma discharge can be generated with higher power, whereby ignition performance can be further improved.

Also, according to the above configuration 1, since the center electrode and the terminal electrode are fixed to the insulator by means of the glass seal, the two electrodes can be firmly fixed to the insulator. Thus, loosening of the terminal electrode from the insulator or a like problem stemming from vibration or the like can be more reliably restrained. As a result, the center electrode and the terminal electrode can be more reliably held in contact with each other over a long period of time; thus, the above-mentioned effect of improving ignition performance can be maintained over a long period of time. Also, through improvement of vibration resistance, excellent gastightness can be implemented between the terminal electrode and the insulator.

Configuration 2. A high-frequency plasma ignition plug of the present configuration is characterized in that, in the above configuration 1, a portion of the electrode which is located within the axial bore and whose sectional area taken orthogonally to the axis is minimal has a minimum sectional area S1 of 0.20 $mm^2$ or more.

According to the above configuration 2, since the electrode has a sufficiently large minimum sectional area S1 of 0.20 $mm^2$ or more, a power transmission path can have a sufficiently low resistance. As a result, power loss can be further restrained, whereby ignition performance can be further improved.

Configuration 3. A high-frequency plasma ignition plug of the present configuration is characterized in that, in the above configuration 1 or 2, the center electrode comprises a center electrode body located at a forward side of the center electrode and a connection extension extending rearward from the center electrode body along the axis and smaller in diameter than the center electrode body;

the terminal electrode has a hole which opens forward;

the connection extension is inserted into the hole; and the glass seal is provided at least in a space defined by an outer circumferential surface of the connection extension, an inner circumferential surface of the axial bore, a forward end surface of the terminal electrode, and a rear end surface of the center electrode body.

According to the above configuration 3, there can be more readily implemented the configuration in which, while the center electrode and the terminal electrode are in direct contact with each other, the two electrodes are fixed to the insulator by means of the glass seal (the above configuration 1). Also, since the connection extension is inserted into the hole of the terminal electrode, the two electrodes can be more reliably brought into contact with each other, and power loss can be further restrained.

Configuration 4. A high-frequency plasma ignition plug of the present configuration is characterized in that, in the above configuration 3, a relational expression $S3-S2 \geq 1.2$ is satisfied, where S2 ($mm^2$) is a sectional area of the connection extension taken orthogonally to the axis at a position of opening of the hole and S3 ($mm^2$) is a sectional area of a region surrounded by an outline of an outer circumferential surface of the terminal electrode as viewed on a section, taken orthogonally to the axis, of a portion of the terminal electrode whose surface is in contact with the glass seal and whose outside diameter is maximal.

According to the above configuration 4, as viewed on a plane which is orthogonal to the axis and on which there is projected a portion of the terminal electrode which is in contact (in press contact) with the glass seal along the axial direction (a particularly important portion of the terminal electrode in fixation of the terminal electrode to the glass seal and, in turn, to the insulator), the projected area (S3−S2) can be sufficiently large. Therefore, the terminal electrode can be more reliably fixed to the glass seal and, in turn, to the insulator; thus, vibration resistance can be further improved. As a result, the center electrode and the terminal electrode can be in contact with each other stably over a long period of time, so that the effect of improving ignition performance can be maintained over a long period of time. Also, gastightness between the terminal electrode and the insulator can be further improved.

Configuration 5. A high-frequency plasma ignition plug of the present configuration is characterized in that, in the above configuration 3 or 4, a portion of the connection extension whose outer circumferential surface is in contact with the glass seal is formed from copper (Cu), silver (Ag), gold (Au), zinc (Zn), or aluminum (Al), or an alloy which contains any one of these metals as a main component.

According to the above configuration 5, a portion of the connection extension whose outer circumferential surface is in contact with the glass seal (i.e., a portion where there is particular concern about power loss in transmission of high-frequency power) is formed from a metal having excellent electrical conductivity, such as Cu, Ag, etc. Therefore, power loss can be further restrained in transmission of high-frequency power, whereby ignition performance can be further improved.

Configuration 6. A high-frequency plasma ignition plug of the present configuration is characterized in that, in any one of the above configurations 3 to 5, a portion of the connection extension whose outer circumferential surface is in contact with the glass seal is covered with Cu, Ag, Au, Zn, or Al, or an alloy which contains any one of these metals as a main component.

High frequency is transmitted primarily on the surface of a substance that is electrically conductive by nature (skin effect); in this connection, according to the above configuration 6, a portion of the connection extension whose outer circumferential surface is in contact with the glass seal is covered with a metal having excellent electrical conductivity, such as Cu, Ag, etc. Therefore, an electric-conduction path for high-frequency power transmitted on the surface of the connection extension can be further reduced in resistance, whereby power loss can be further restrained. As a result, ignition performance can be further improved.

Configuration 7. A high-frequency plasma ignition plug of the present configuration is characterized in that, in any one of the above configurations 3 to 6, the connection extension is press-fitted into the hole.

According to the above configuration 7, the contact area of the center electrode (connection extension) with the terminal electrode can be reliably increased, whereby the contact resistance between the two electrodes can be reduced. As a result, power loss can be further restrained, so that excellent ignition performance can be implemented.

Configuration 8. A high-frequency plasma ignition plug of the present configuration is characterized in that, in any one of the above configurations 3 to 6, the connection extension is threadingly engaged with the hole.

According to the above configuration 8, similar to the above configuration 7, the contact area of the center electrode (connection extension) with the terminal electrode can be reliably increased, whereby the contact resistance between the two electrodes can be reduced. As a result, ignition performance can be further improved.

Configuration 9. A high-frequency plasma ignition plug of the present configuration is characterized in that, in the above configuration 1 or 2, the terminal electrode comprises a terminal electrode body located at a rear side of the terminal electrode and an extension extending forward from the terminal electrode body along the axis and smaller in diameter than the terminal electrode body;

the center electrode has a recess which opens rearward;

the extension is inserted into the recess; and the glass seal is provided at least in a space defined by an outer circumferential surface of the extension, an inner circumferential surface of the axial bore, a forward end surface of the terminal electrode body, and a rear end surface of the center electrode.

The above configuration 9 yields actions and effects basically similar to those yielded by the above configuration 3.

Additionally, according to the above configuration 9, since the glass seal is disposed externally of the outer circumference of the extension of the terminal electrode, the terminal electrode can be more firmly fixed to the insulator. As a result, vibration resistance and, in turn, gastightness can be further improved.

Configuration 10. A high-frequency plasma ignition plug of the present configuration is characterized in that, in the above configuration 9, a portion of the extension whose outer circumferential surface is in contact with the glass seal is formed from Cu, Ag, Au, Zn, or Al, or an alloy which contains any one of these metals as a main component.

The above configuration 10 yields actions and effects basically similar to those yielded by the above configuration 5.

Configuration 11. A high-frequency plasma ignition plug of the present configuration is characterized in that, in the above configuration 9 or 10, a portion of the extension whose outer circumferential surface is in contact with the glass seal is covered with Cu, Ag, Au, Zn, or Al, or an alloy which contains any one of these metals as a main component.

The above configuration 11 yields actions and effects basically similar to those yielded by the above configuration 6.

Configuration 12. A high-frequency plasma ignition plug of the present configuration is characterized in that, in any one of the above configurations 9 to 11, the extension is press-fitted into the recess.

The above configuration 12 yields actions and effects basically similar to those yielded by the above configuration 7.

Configuration 13. A high-frequency plasma ignition plug of the present configuration is characterized in that, in any one of the above configurations 9 to 11, the extension is threadingly engaged with the recess.

The above configuration 13 yields actions and effects basically similar to those yielded by the above configuration 8.

Configuration 14. A high-frequency plasma ignition plug of the present configuration is characterized in that, in any one of the above configurations 1 to 13, the glass seal contains a metal component.

According to the above configuration 14, since the glass seal contains a metal component, the resistance of the glass seal can be effectively reduced. Therefore, power loss can be further restrained in transmission of high-frequency power, whereby ignition performance can be further improved.

DETAILED DESCRIPTION OF THE INVENTION

Embodiments of the present invention will next be described with reference to the drawings.

[First Embodiment]

Figure 1:
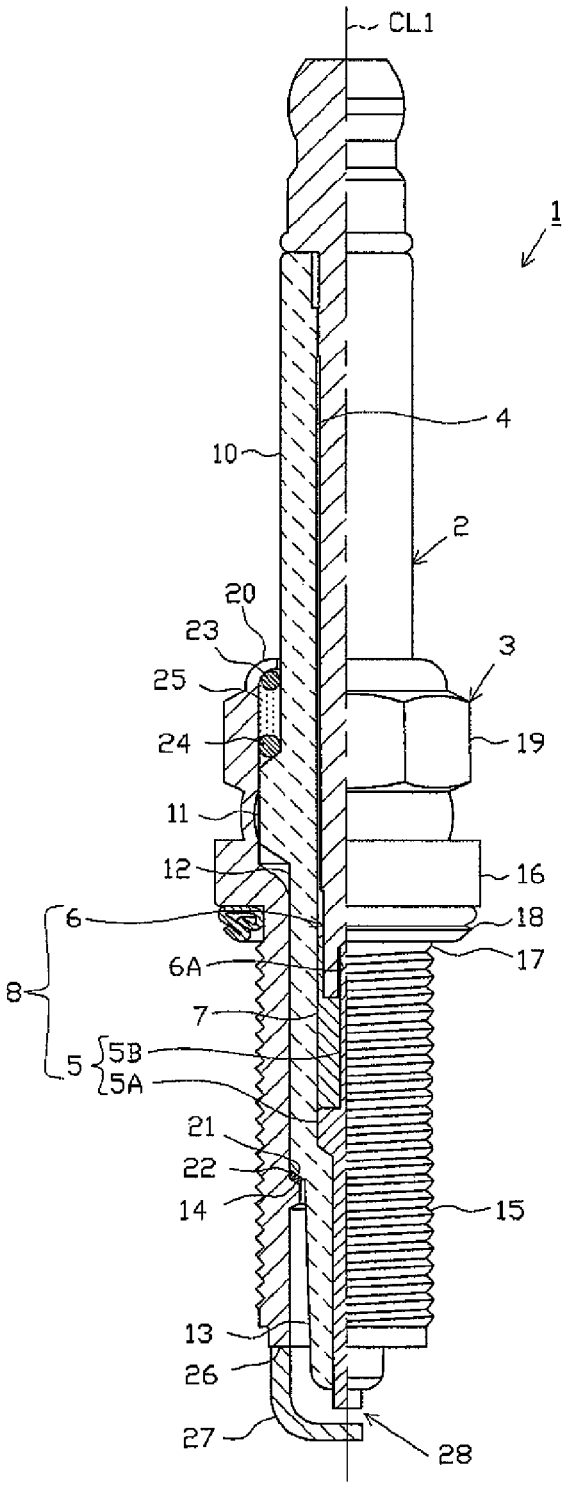
FIG. 1 is a partially cutaway front view showing the configuration of an ignition plug.

FIG. 1 is a partially cutaway front view showing a high-frequency plasma ignition plug (hereinafter, referred to as the "ignition plug") 1 which generates high-frequency plasma through supply of high-frequency power thereto from a predetermined high-frequency power supply (not shown). In the following description, the direction of an axis CL1 of the ignition plug 1 in FIG. 1 is referred to as the vertical direction, and the lower side of the ignition plug 1 in FIG. 1 is referred to as the forward side of the ignition plug 1, and the upper side as the rear side of the ignition plug 1.

The ignition plug 1 includes a ceramic insulator 2, which corresponds to the insulator in the present invention, and a tubular metallic shell 3, which holds the ceramic insulator 2.

The ceramic insulator 2 is formed from alumina or the like by firing, as well known in the art. The ceramic insulator 2 externally includes a rear trunk portion 10 formed on the rear side; a large-diameter portion 11 located forward of the rear trunk portion 10 and projecting radially outward; an intermediate trunk portion 12 located forward of the large-diameter portion 11 and being smaller in diameter than the large-diameter portion 11; and a leg portion 13 located forward of the intermediate trunk portion 12 and being smaller in diameter than the intermediate trunk portion 12. Additionally, the large-diameter portion 11, the intermediate trunk portion 12, and most of the leg portion 13 of the ceramic insulator 2 are accommodated in the metallic shell 3. A tapered, stepped portion 14 is formed at a connection portion between the intermediate trunk portion 12 and the leg portion 13, and the ceramic insulator 2 is seated on the metallic shell 3 via the stepped portion 14.

Furthermore, the ceramic insulator 2 has an axial bore 4 extending therethrough along the axis CL1, and the electrode 8 is fixedly inserted into the axial bore 4. The electrode 8 includes a center electrode 5 inserted into the forward side of the axial bore 4 and a terminal electrode 6 inserted into the rear side of the axial bore 4.

The center electrode 5 assumes a rodlike shape as a whole and is formed from an Ni alloy which contains nickel (Ni) as a main component. The center electrode 5 is inserted into the axial bore 4 in a state in which its forward end projects forward along the direction of the axis CL1 from the forward end of the ceramic insulator 2. Additionally, the terminal electrode 6 is formed from a metal, such as low-carbon steel, and is inserted into the axial bore 4 in a state in which its rear end portion projects from the rear end of the ceramic insulator 2 (the configuration of the electrode 8 will be described in detail later).

Additionally, the center electrode 5 and the terminal electrode 6 are fixed, within the axial bore 4, to the ceramic insulator 2 by means of a glass seal 7 formed by sintering a mixture of metal powder (e.g., copper powder, brass powder, iron powder, etc.), glass powder, etc. The glass seal 7 is fired in such a state as to be pressed from the rear side by the terminal electrode 6. Thus, a forward end portion of the terminal electrode 6 is in such a state as to be pressed against the glass seal 7.

The metallic shell 3 is formed into a tubular shape from a low-carbon steel or the like and has a threaded portion (externally threaded portion) 15 on its outer circumferential surface, and the threaded portion 15 is adapted to mount the ignition plug 1 into a mounting hole of a combustion apparatus (e.g., an internal combustion engine or a fuel cell reformer). The metallic shell 3 has a seat portion 16 formed on its outer circumferential surface and located rearward of the threaded portion 15. A ring-like gasket 18 is fitted to a screw neck 17 located at the rear end of the threaded portion 15. Furthermore, the metallic shell 3 also has a tool engagement portion 19 provided near its rear end. The tool engagement portion 19 has a hexagonal cross section and allows a tool such as a wrench to be engaged therewith when the metallic shell 3 is to be mounted to the combustion apparatus. The metallic shell 3 also has a crimp portion 20 provided at its rear end portion and adapted to hold the ceramic insulator 2.

The metallic shell 3 has a tapered, stepped portion 21 provided on its inner circumferential surface and adapted to allow the ceramic insulator 2 to be seated thereon. The ceramic insulator 2 is inserted forward into the metallic shell 3 from the rear end of the metallic shell 3. In a state in which the stepped portion 14 of the ceramic insulator 2 butts against the stepped portion 21 of the metallic shell 3, a rear-end opening portion of the metallic shell 3 is crimped radially inward; i.e., the crimp portion 20 is formed, whereby the ceramic insulator 2 is fixed to the metallic shell 3. An annular sheet packing 22 intervenes between the stepped portions 14 and 21 of the ceramic insulator 2 and the metallic shell 3, respectively. This intervention of the sheet packing 22 retains gastightness of a combustion chamber and prevents leakage of fuel gas to the exterior of the ignition plug 1 through a clearance between the inner circumferential surface of the metallic shell 3 and the leg portion 13 of the ceramic insulator 2, the clearance being exposed to the combustion chamber.

Furthermore, in order to ensure gastightness which is established by crimping, annular ring members 23 and 24 intervene between the metallic shell 3 and the ceramic insulator 2 in a region near the rear end of the metallic shell 3, and a space between the ring members 23 and 24 is filled with a powder of tale 25. That is, the metallic shell 3 holds the ceramic insulator 2 via the sheet packing 22, the ring members 23 and 24, and the talc 25.

A ground electrode 27 is joined to a forward end portion 26 of the metallic shell 3. The ground electrode 27 is formed from an alloy which contains Ni as a main component, and is bent substantially at its intermediate portion. A side surface of a distal end portion of the ground electrode 27 faces a forward end portion of the electrode 8 (center electrode 5), and a gap 28 is formed between the ground electrode 27 and the forward end portion of the electrode 8. Through supply of high-frequency power to the gap 28, plasma discharge can be generated.

Next, the configuration of the electrode 8 (the center electrode 5 and the terminal electrode 6), etc., will be described in detail.

Figure 2:
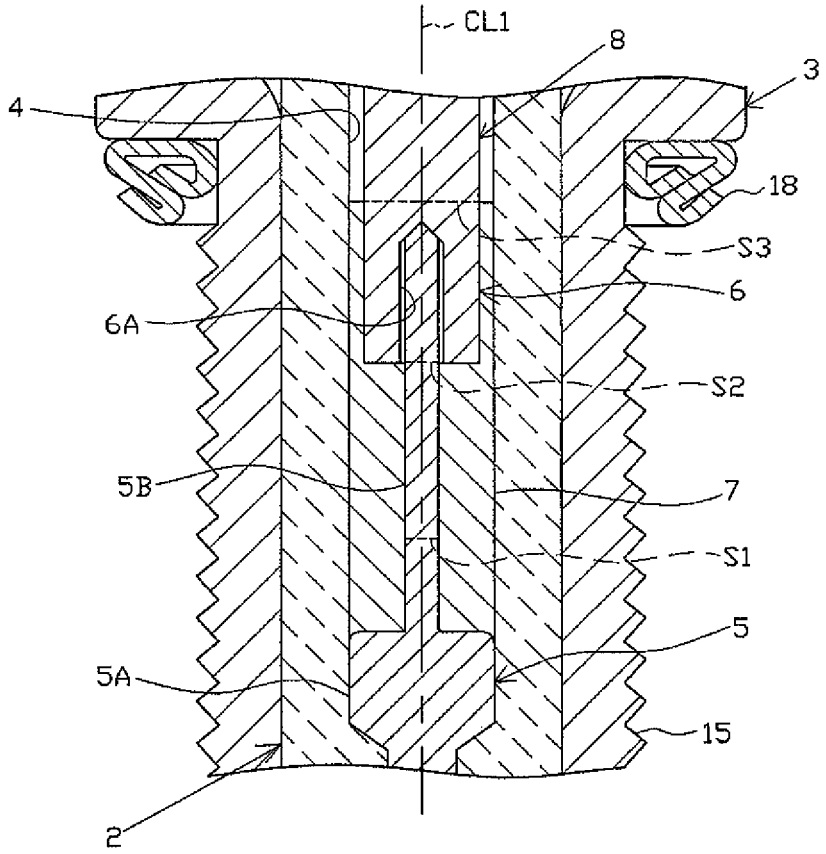
FIG. 2 is an enlarged fragmentary, sectional view showing the configuration of a center electrode and a terminal electrode.

As shown in FIG. 2, the center electrode 5 includes a center electrode body 5A located at the forward side with respect to the direction of the axis CL1 and a connection extension 5B located at the rear side with respect to the direction of the axis CL1 and formed integrally with the center electrode body 5A.

The center electrode body 5A projects from the forward end of the ceramic insulator 2 so as to form the gap 28 between its forward end portion and the ground electrode 27, and is engaged with the inner circumferential surface of the axial bore 4 by means of its flange portion provided at its rear end and projecting radially outward.

The connection extension 5B has a rodlike shape and extends rearward along the axis CL1 from the center position of the rear end of the center electrode body 5A. Also, the connection extension 5B is smaller in diameter than the center electrode body 5A (particularly, a maximum-diameter portion of the center electrode body 5A), and the glass seal 7 is disposed around the connection extension 5B.

The terminal electrode 6 has a hole 6A formed in its forward end portion and opening forward with respect to the direction of the axis CL1. The connection extension 5B is inserted into the hole 6A with some radial gap left around the connection extension 5B such that at least a rear end portion of the center electrode 5 (the connection extension 5B) is in direct contact with the terminal electrode 6. Also, the glass seal 7 is provided in a space defined by the outer circumferential surface of the connection extension 5B, the inner circumferential surface of the axial bore 4, the forward end surface of the terminal electrode 6, and the rear end surface of the center electrode body 5A.

Figure 3:
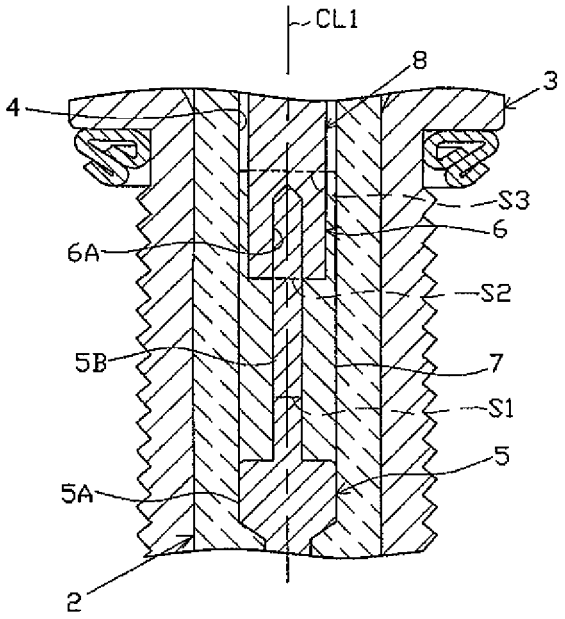
FIGS. 3(*a*) and 3(*b*) are enlarged fragmentary, sectional views showing other examples of how to insert a connection extension into a hole.
Figure 3:
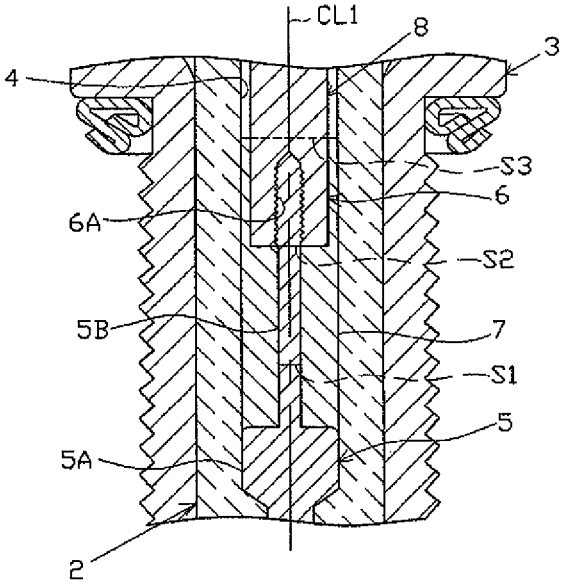

As shown in FIG. 3(*a*), the connection extension 5B may be press-fitted into the hole 6A so as to bring the entire outer circumferential surface of a portion of the connection extension 5B disposed within the hole 6A into contact with the terminal electrode 6. Also, as shown in FIG. 3(*b*), the following connection method may be employed: internal threads are formed in the hole 6A; external threads are formed on the outer circumferential surface of a rear end portion of the connection extension 5B; and the connection extension 5B is threadingly engaged with the hole 6A, thereby more reliably bringing the outer circumferential surface of a portion of the connection extension 5B disposed within the hole 6A into contact with the terminal electrode 6.

Also, a portion of the electrode 8 (the center electrode 5 and the terminal electrode 6) which is located within the axial bore 4 and whose sectional area taken orthogonally to the axis CL1 is minimal (in the present embodiment, the portion is the connection extension 5B) has a minimum sectional area S1 of 0.20 $mm^2$ or more.

Additionally, the present embodiment is configured to satisfy the relational expression S3−S2≥1.2 where S2 ($mm^2$) is the sectional area of the connection extension 5B taken orthogonally to the axis CL1 at the position of the opening of the hole 6A, and S3 ($mm^2$) is the sectional area of a region surrounded by the outline of the outer circumferential surface of the terminal electrode 6 as viewed on a section, taken orthogonally to the axis CL1, of a portion of the terminal electrode 6 whose surface is in contact with the glass seal 7 and whose outside diameter is maximal (in the present embodiment, the sectional area is "the maximum sectional area, taken orthogonally to the axis CL1, of a portion of the terminal electrode 6 whose surface is in contact with the glass seal 7"). That is, in order to firmly fix the terminal electrode 6 to the glass seal 7 and, in turn, to the ceramic insulator 2, a portion of the terminal electrode 6 which is pressed against the glass seal 7 along the direction of the axis CL1 must have a sufficiently large size; in this connection, the present embodiment is configured such that, as viewed on a plane which is orthogonal to the axis CL1 and on which the portion of the terminal electrode 6 is projected, the projected area of the portion (i.e., S3−S2) is sufficiently large.

Furthermore, in the present embodiment, a portion of the connection extension 5B whose outer circumferential surface is in contact with the glass seal 7 is covered with copper (Cu), silver (Ag), gold (Au), zinc (Zn), or aluminum (Al), or an alloy which contains any one of these metals as a main component.

Figure 4:
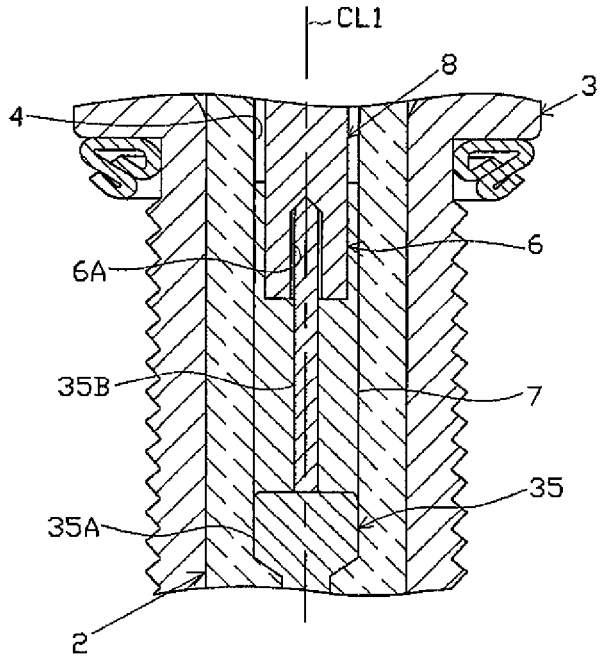
FIGS. 4(*a*) and 4(*b*) are enlarged fragmentary, sectional view showing the configuration of the center electrode in the case where a center electrode body and a Connection extension are provided as separate members.
Figure 4:
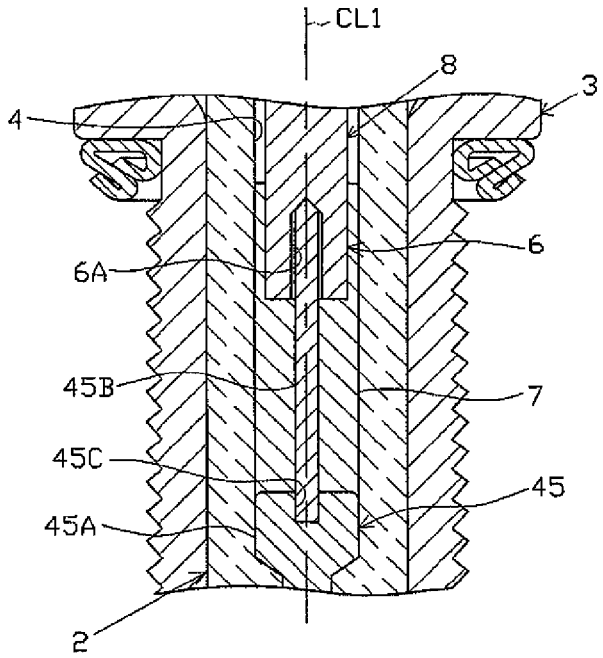

Alternatively, a portion of the connection extension 5B whose outer circumferential surface is in contact with the glass seal 7 may be formed from Cu, Ag, Au, Zn, or Al, or an alloy which contains any one of these metals as a main component. In this case, as shown in FIG. 4(*a*), a center electrode 35 may be formed as follows: a center electrode body 35A and a connection extension 35B formed from a metal such as Cu are prepared separately, and the connection extension 35B is welded to the center electrode body 35A. Alternatively, as shown in FIG. 4(*b*), a center electrode 45 may be formed as follows: a connection extension 45B is press-fitted into an insertion hole 45C provided in a rear end portion of a center electrode body 45A so as to join the connection extension 45B and the center electrode body 45A together. In this case, the connection extension 45B may be joined to the center electrode body 45A as follows: external threads are formed on a forward end portion of the connection extension 45B, and the externally threaded portion of the connection extension 45B is threadingly engaged with the insertion hole 45C.

As described in detail above, according to the present embodiment, since the center electrode 5 and the terminal electrode 6 are in direct contact with each other without need to provide the glass seal 7 therebetween, power loss can be effectively restrained in transmission of supplied high-frequency power. As a result, plasma discharge can be generated with higher power, whereby ignition performance can be further improved.

Also, since the center electrode 5 and the terminal electrode 6 are fixed to the ceramic insulator 2 by means of the glass seal 7, the electrodes 5 and 6 can be firmly fixed to the ceramic insulator 2. Thus, even upon reception of vibration stemming from operation of a combustion apparatus or the like, loosening of the terminal electrode 6 or a like problem can be more reliably restrained. As a result, the center electrode 5 and the terminal electrode 6 can be more reliably held in contact with each other over a long period of time; thus, the effect of improving ignition performance can be maintained over a long period of time. Also, through improvement of vibration resistance, excellent gastightness can be implemented between the terminal electrode 6 and the ceramic insulator 2.

Furthermore, since the electrode 8 (the center electrode 5 and the terminal electrode 6) has a sufficiently large minimum sectional area S1 of 0.20 $mm^2$ or more, power loss in transmission of high-frequency power can be further restrained. As a result, ignition performance can be further improved.

Additionally, since the connection extension 5B of the center electrode 5 is inserted into the hole 6A of the terminal electrode 6, the electrodes 5 and 6 can be more reliably brought in contact with each other; thus, power loss can be further restrained. Also, by means of the connection extension 5B being press-fitted into or threadingly engaged with the hole 6A, the contact area between the terminal electrode 6 and the center electrode 5 (the connection extension 5B) can be reliably increased, whereby the contact resistance between the electrodes 5 and 6 can be reduced. As a result, power loss can be further restrained, so that excellent ignition performance can be implemented.

Also, a portion of the connection extension 5B whose outer circumferential surface is in contact with the glass seal 7 is covered with a metal having excellent electrical conductivity, such as Cu or Ag. Therefore, an electric-conduction path for high-frequency power transmitted on the surface of the connection extension 5B can be further reduced in resistance, whereby power loss can be further restrained. As a result, ignition performance can be further improved.

Also, as viewed on a plane which is orthogonal to the axis CL1 and on which there is projected a portion of the terminal electrode 6 which is in contact (in press contact) with the glass seal 7 along the direction of the axis CL1, the projected area (S3−S2) is rendered sufficiently large. Therefore, the terminal electrode 6 can be more reliably fixed to the glass seal 7 and, in turn, to the ceramic insulator 2; thus, vibration resistance can be further improved. As a result, the center electrode 5 and the terminal electrode 6 can be in contact with each other stably over a long period of time, so that the effect of improving ignition performance can be maintained over a long period of time. Also, gastightness between the terminal electrode 6 and the ceramic insulator 2 can be further improved.

Furthermore, since the glass seal 7 contains a metal component, the resistance of the glass seal 7 can be reduced. Therefore, power loss can be further restrained in transmission of high-frequency power, whereby ignition performance can be further improved.

[Second Embodiment]

Figure 5:
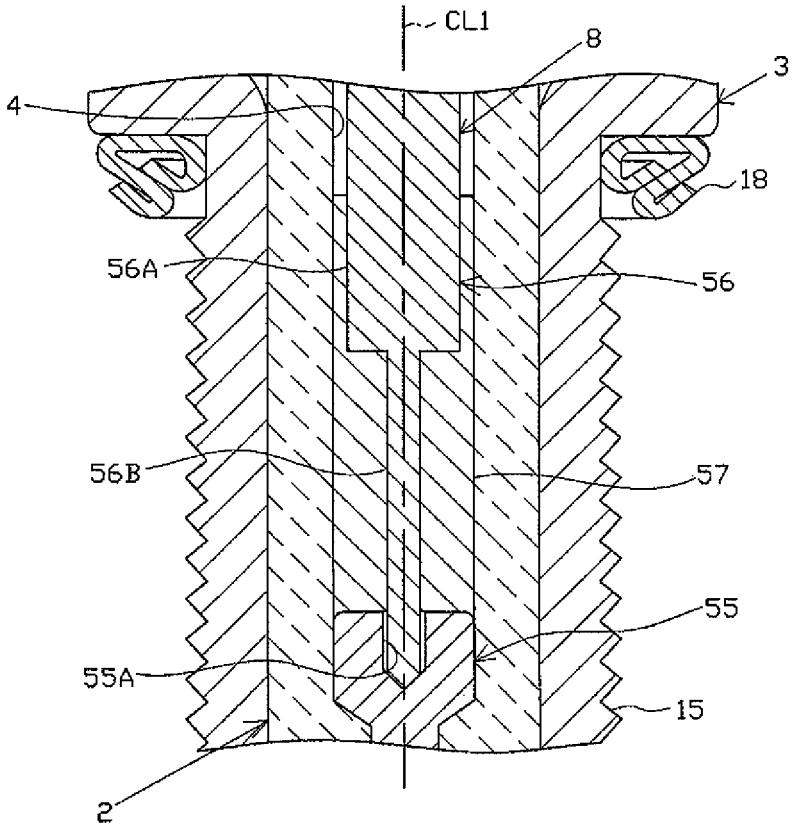
FIG. 5 is an enlarged fragmentary, sectional view showing the configuration of a center electrode and a terminal electrode in a second embodiment.

Next, a second embodiment of the present invention will be described, centering on points of difference from the first embodiment described above. The second embodiment differs from the first embodiment in a mode of connection between the center electrode and the terminal electrode. Specifically, as shown in FIG. 5, a terminal electrode 56 includes a terminal electrode body 56A located at the rear side with respect to the direction of the axis CL1 and an extension 56B extending forward along the axis CL1 from a forward end portion of the terminal electrode body 56A. Also, a center electrode 55 has a recess 55A which is located at a rear end portion of the center electrode 55 and opens rearward with respect to the direction of the axis CL1 and into which the extension 56B is inserted. The extension 56B is formed smaller in diameter than the terminal electrode body 56A, and a glass seal 57 is provided in a space defined by the outer circumferential surface of the extension 56B, the inner circumferential surface of the axial bore 4, the forward end surface of the terminal electrode body 56A, and the rear end surface of the center electrode 55.

Figure 6:
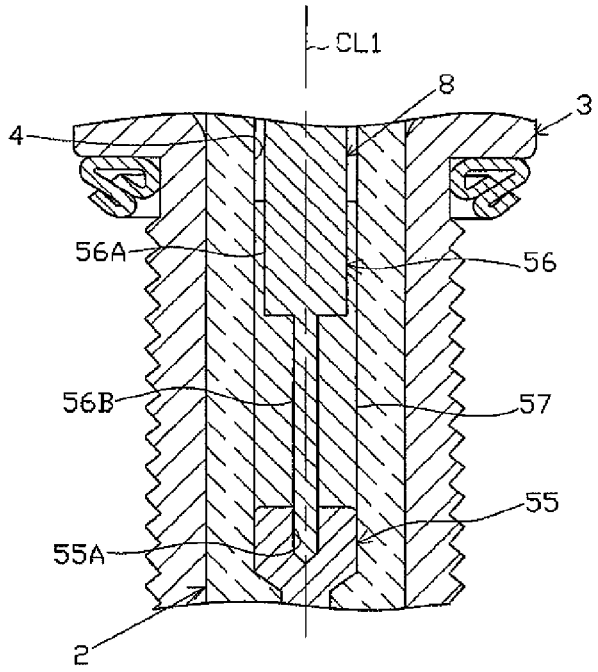
FIGS. 6(*a*) and 6(*b*) are enlarged fragmentary, sectional views showing other examples of how to insert an extension into a recess.
Figure 6:
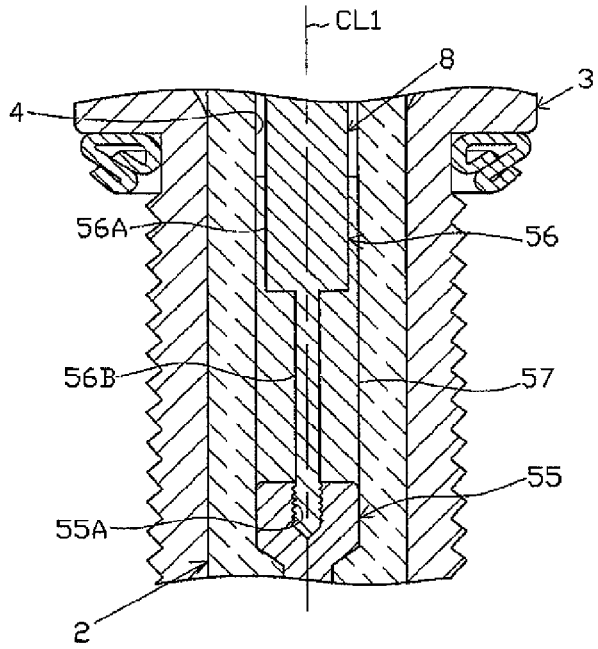

As shown in FIG. 6(*a*), the extension 56B may be press-fitted into the recess 55A so as to bring the entire outer circumferential surface of a portion of the extension 56B disposed within the recess 55A into contact with the center electrode 55. Also, as shown in FIG. 6(*b*), the following connection method may be employed: internal threads are formed in the recess 55A; external threads are formed on the outer circumferential surface of a forward end portion of the extension 56A; and the extension 56B is threadingly engaged with the recess 55A, thereby more reliably bringing the outer circumferential surface of a portion of the extension 56B disposed within the recess 55A into contact with the center electrode 55.

Also, a portion of the extension 56B whose outer circumferential surface is in contact with the glass seal 57 is covered with Cu, Ag, Au, Zn, or Al, or an alloy which contains any one of these metals as a main component. Alternatively, a portion of the extension 5613 whose outer circumferential surface is in contact with the glass seal 57 may be formed from Cu, Ag, Au, Zn, or Al, or an alloy which contains any one of these metals as a main component.

As described above, the second embodiment yields actions and effects basically similar to those yielded by the first embodiment described above.

Additionally, since the glass seal 57 is disposed externally of the outer circumference of the extension 56B of the terminal electrode 56, the terminal electrode 56 can be more firmly fixed to the ceramic insulator 2. As a result, gastightness and vibration resistance can be further improved.

Figure 7:
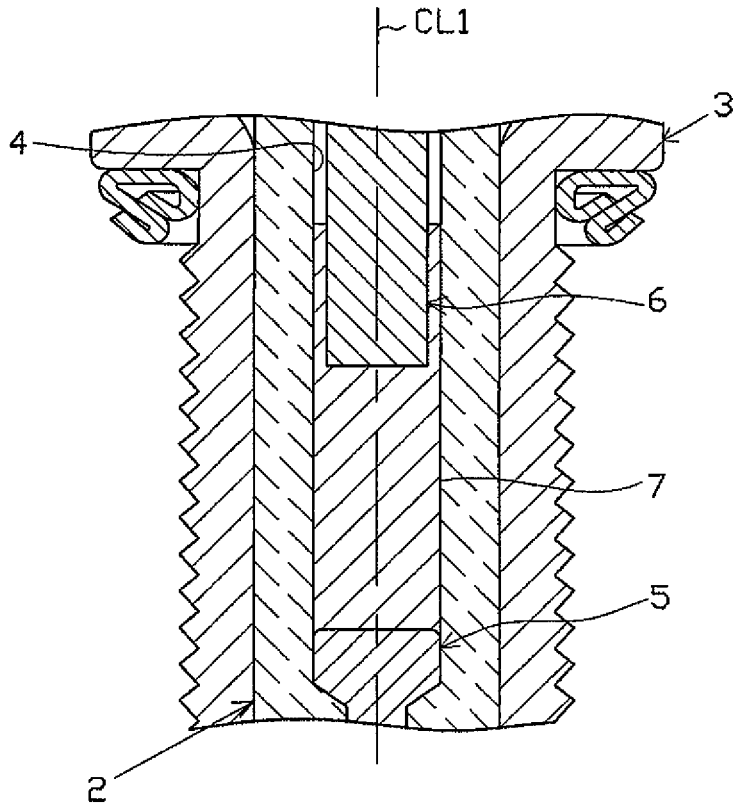
FIG. 7 is an enlarged fragmentary, sectional view showing the schematic configuration of a sample prepared as a Comparative Example.

Next, in order to verify actions and effects to be yielded by the above embodiments, there were manufactured a spark plug sample A (Comparative Example) in which the glass seal was provided between the center electrode and the terminal electrode as shown in FIG. 7, whereby the two electrodes were electrically connected to each other via the glass seal, and spark plug samples B, C, D, and E (Examples) in which the center electrode and the terminal electrode were in direct contact with each other and which differed in the minimum sectional area S1 of a portion of the center and terminal electrodes, the portion being located within the axial bore and being minimal in sectional area taken orthogonally to the axis. The samples were subjected to an ignition performance evaluation test. The ignition performance evaluation test is briefly described below. The samples were mounted to a 4-cylinder DOHC engine of 2,000 cc displacement. The engine was operated at an air-fuel ratio (A/F) of 20 while high-frequency power having an output of 300 W and an oscillation frequency of 13 MHz was supplied 1,000 times to the samples. The number of times of misfire (misfire count) was counted out of 1,000 times of supply. The samples having a misfire count of 0 were evaluated as "Excellent," indicating that the samples have excellent ignition performance, and the samples having a misfire count of 1 to 4 were evaluated as "Good," indicating that the samples have good ignition performance. Meanwhile, the samples having a misfire count of 5 or more were evaluated as "Poor," indicating that the samples have poor ignition performance. Table 1 shows the results of the ignition performance evaluation test. In the Example samples, the sectional area S1 was varied by adjusting the outside diameter of the connection extension of the center electrode (Table 1 also shows the outside diameter of the connection extension).

TABLE 1

| | Outside dia. of connection extension (mm) | Minimum sectional area S1 ($mm^2$) | Evaluation of ignition performance |
|---|---|---|---|
| Sample A | — | — | Poor |
| Sample B | 1.5 | 1.77 | Excellent |
| Sample C | 1.0 | 0.79 | Excellent |
| Sample D | 0.5 | 0.20 | Excellent |
| Sample E | 0.3 | 0.07 | Good |

As shown in Table 1, misfire is apt to occur in the sample A in which the center electrode and the terminal electrode are electrically connected to each other via the glass seal, indicating that the sample A is poor in ignition performance. Conceivably, this is for the following reason: power loss arose due to the presence of the glass seal, and, in turn, power supplied to the gap between the center electrode and the ground electrode became insufficient.

By contrast, the samples B to E in which the center electrode and the terminal electrode are in direct contact with each other have been found to be excellent in ignition performance. Conceivably, this is for the following reason: by virtue of direct contact between the two electrodes, power loss was able to be restrained to the greatest possible extent, and, in turn, sufficiently high power was supplied to the gap.

Particularly, it has been confirmed that the samples B to D having a minimum sectional area S1 of 0.20 $mm^2$ or more can implement excellent ignition performance. Conceivably, this is for the following reason: by virtue of employment of a sufficiently large sectional area, the resistance of an electric-conduction path (from the rear end of the terminal electrode to the forward end of the center electrode) for power was able to be sufficiently reduced, whereby power loss was further reduced.

From the above test results, in order to improve ignition performance of a high-frequency plasma ignition plug which generates plasma discharge through supply of high-frequency power thereto, preferably, the center electrode and the terminal electrode are in direct contact with each other. Also, in order to further improve ignition performance, more preferably, the minimum sectional area S1 of the electrode located within the axial bore is 0.20 $mm^2$ or more.

Next, there were manufactured a spark plug sample F in which the center electrode and the terminal electrode were brought into contact with each other through insertion of the connection extension of the center electrode into the hole of the terminal electrode with some radial gap left around the connection extension; a spark plug sample G in which the two electrodes were brought into contact with each other through press-fitting of the connection extension into the hole; and a spark plug sample H in which the two electrodes were brought into contact with each other through threaded engagement of the connection extension with the hole. The samples were subjected to the above-mentioned ignition performance evaluation test at an air-fuel ratio (A/F) of 21 (i.e., under the condition that misfire is more likely to occur). Table 2 shows the results of the ignition performance evaluation test. The samples had an outside diameter of the connection extension of 1.0 mm (a minimum sectional area S1 of about 0.79 $mm^2$).

TABLE 2

| | Sample F | Sample G | Sample H |
|---|---|---|---|
| Evaluation of ignition performance | Good | Excellent | Excellent |

As shown in Table 2, the sample G in which the connection extension is press-fitted into the hole and the sample H in which the connection extension is threadingly engaged with the hole can implement quite excellent ignition performance even under the condition that misfire is more likely to occur due to thin fuel. Conceivably, this is for the following reason: by virtue of an increase in the contact area of the connection extension with the terminal electrode, the contact resistance between the two electrodes was reduced, and, in turn, power loss was further restrained.

From the above test results, in order to further improve ignition performance, preferably, the center electrode and the terminal electrode are joined together through press fit or threaded engagement.

Next, there were manufactured spark plug samples I, J, K, and L which differed in "S3−S2" by varying the sectional area S2 ($mm^2$) of the connection extension taken orthogonally to the axis at the position of the opening, while the sectional area S3 ($mm^2$) was held constant. The samples were subjected to a vibration resistance evaluation test. The vibration resistance evaluation test is briefly described below. The samples were mounted to a predetermined test apparatus. Impact having a stroke of 22 mm was applied to the samples 400 times per minute for 10 minutes according to the impact resistance test specified in JIS B8031. Subsequently, the samples were checked for looseness of the terminal electrode. The samples free from looseness of the terminal electrode were evaluated as "Good," indicating that the samples have excellent vibration resistance; meanwhile, the samples suffering from looseness of the terminal electrode were evaluated as "Fair," indicating that the samples have rather poor vibration resistance.

Table 3 shows the results of the vibration resistance evaluation test. The sectional area S2 was varied by adjusting the outside diameter of the connection extension (Table 3 also shows the outside diameter of the connection extension). Also, a portion of the axial bore in which the glass seal and a forward end portion of the terminal electrode were disposed had an inside diameter of 3.9 mm.

TABLE 3

| | Outside dia. of connection extension (mm) | S3-S2 ($mm^2$) | Evaluation of vibration resistance |
|---|---|---|---|
| Sample I | 3.0 | 4.9 | Good |
| Sample J | 3.5 | 2.3 | Good |
| Sample K | 3.7 | 1.2 | Good |
| Sample L | 3.8 | 0.6 | Fair |

As shown in Table 3, the samples I, J, and K having an "S3−S2" of 1.2 $mm^2$ or more are free from looseness of the terminal electrode and thus have excellent vibration resistance. Conceivably, this is for the following reason: a portion of the terminal electrode in press contact with the glass seal along the axial direction had a sufficiently large area, thereby improving the strength of joining the terminal electrode to the glass seal and, in turn, to the ceramic insulator.

From the above test results, in view of effective improvement of vibration resistance and gastightness, preferably, the relational expression "S3−S2≥1.2 $mm^2$" is satisfied.

The present invention is not limited to the above-described embodiments, but may be embodied, for example, as follows. Of course, applications and modifications other than those exemplified below are also possible.

(a) No particular limitation is imposed on a metal powder which partially constitutes the glass seal 7. The metal powder which partially constitutes the glass seal 7 may contain a metal having excellent electrical conductivity, such as Cu or Ag. In this case, power loss can be further restrained, so that ignition performance can be further improved.

(b) Although not particularly mentioned in the description of the above embodiments, external threads or knurls may be provided on the outer circumferential surface (surface in contact with the glass seal 7) of a forward end portion of the terminal electrode 6 or 56. In this case, the terminal electrode 6 or 57 can be firmly fixed to the glass seal 7 or 57 (and, in turn, to the ceramic insulator 2), whereby vibration resistance and, in turn, gastightness can be further improved.

(c) In the above embodiments, the center electrode 5 is formed from an alloy which contains Ni as a main component; however, the center electrode 5 may have an inner layer provided therein and formed from a metal having excellent thermal conductivity, such as copper or a copper alloy. In this case, heat transfer from the center electrode 5 is improved, whereby erosion resistance can be improved. Also, in order to improve erosion resistance, the center electrode 5 and the ground electrode 27 may have a noble metal tip formed from a noble metal, such as platinum or iridium, or an alloy which contains a noble metal as a main component, and provided at respective portions adapted to form the gap 28.

(d) In the above embodiments, the ground electrode 27 is joined to the forward end portion 26 of the metallic shell 3. However, the present invention is applicable to the case where a portion of a metallic shell (or, a portion of an end metal piece welded beforehand to the metallic shell) is formed into a ground electrode by machining (refer to, for example, Japanese Patent Application Laid-Open (kokai) No. 2006-236906).

(e) In the above embodiments, the tool engagement portion 19 has a hexagonal cross section. However, the shape of the tool engagement portion 19 is not limited thereto. For example, the tool engagement portion 19 may have a Bi-HEX (modified dodecagonal) shape [ISO22977:2005(E)] or the like.

DESCRIPTION OF REFERENCE NUMERALS

1: high-frequency plasma ignition plug (ignition plug)
2: ceramic insulator (insulator)
4: axial bore
5, 55: center electrode
5A: center electrode body
5B: connection extension
6, 56: terminal electrode
6A: hole
7: glass seal
8: electrode
55A: recess
56A: terminal electrode body
56B: extension
CL1: axis Having described the invention, the following is claimed:

1. A high-frequency plasma ignition plug comprising:

an insulator having an axial bore extending in a direction of an axis; and an electrode inserted into the axial bore, wherein a plasma discharge is generated through supply, to the electrode, of high-frequency power generated by a predetermined high-frequency power supply, the electrode comprising:

a center electrode inserted into a forward side of the axial bore, the center electrode including a center electrode body located at a forward side of the center electrode and a connection extension extending rearward from the center electrode body along the axis and smaller in diameter than the center electrode body, and a terminal electrode inserted into a rear side of the axial bore, the terminal electrode having a hole which opens forward, wherein the connection extension is inserted into the hole, wherein the center electrode and the terminal electrode are in direct contact with each other; and wherein in the axial bore, the terminal electrode and the center electrode are fixed to the insulator by means of a glass seal which contains a glass component, the glass seal is provided at least in a space defined by an outer circumferential surface of the connection extension, an inner circumferential surface of the axial bore, a forward end surface of the terminal electrode, and a rear end surface of the center electrode body; and a relational expression $S3-S2 \geq 1.2$ is satisfied, where $S2$ ($mm^2$) is a sectional area of the connection extension taken orthogonally to the axis at a position of opening of the hole, and $S3$ ($mm^2$) is a sectional area of a region surrounded by an outline of an outer circumferential surface of the terminal electrode as viewed on a section, taken orthogonally to the axis, of a portion of the terminal electrode whose surface is in contact with the glass seal and whose outside diameter is maximal.

2. A high-frequency plasma ignition plug according to claim 1, wherein a portion of the electrode which is located within the axial bore and whose sectional area taken orthogonally to the axis is minimal has a minimum sectional area S1 of 0.20 $mm^2$ or more.

3. A high-frequency plasma ignition plug according to claim 1, wherein a portion of the connection extension whose outer circumferential surface is in contact with the glass seal is formed from copper, silver, gold, zinc, or aluminum, or an alloy which contains any one of these metals as a main component.

4. A high-frequency plasma ignition plug according to claim 1, wherein a portion of the connection extension whose outer circumferential surface is in contact with the glass seal is covered with copper, silver, gold, zinc, or aluminum, or an alloy which contains any one of these metals as a main component.

5. A high-frequency plasma ignition plug according to claim 1, wherein the connection extension is press-fitted into the hole.

6. A high-frequency plasma ignition plug according to claim 1, wherein the connection extension is threadingly engaged with the hole.

7. A high-frequency plasma ignition plug according to claim 1, wherein the glass seal contains a metal component.

* * * * *